US007264147B1

(12) United States Patent
Benson et al.

(10) Patent No.: US 7,264,147 B1
(45) Date of Patent: Sep. 4, 2007

(54) SHOCK RESISTANT BOX

(75) Inventors: Miriam M. Benson, 7887 Broadway, No. 403, San Antonio, TX (US) 78209; Ronald L. Bramble, San Antonio, TX (US)

(73) Assignee: Miriam M. Benson, San Antonio, TX (US)

( * ) Notice: Subject to any disclaimer, the term of this patent is extended or adjusted under 35 U.S.C. 154(b) by 735 days.

(21) Appl. No.: 10/796,642

(22) Filed: Mar. 9, 2004

(51) Int. Cl.
*B65D 5/42* (2006.01)

(52) U.S. Cl. ..... 229/199; 229/5.85; 229/939; 229/117.09; 229/122.32

(58) Field of Classification Search ..... 229/122.32, 229/5.85, 117.09, 939; 206/523
See application file for complete search history.

(56) References Cited

U.S. PATENT DOCUMENTS 1,158,667 A * 11/1915 Fairchild ..... 428/182
2,176,284 A * 10/1939 Whiteford ..... 206/425
2,761,610 A * 9/1956 Welshenbach ..... 229/117.16
2,860,768 A * 11/1958 Smithers ..... 206/523
3,076,589 A * 2/1963 Meijdam ..... 229/100
4,177,935 A * 12/1979 Centanni ..... 229/122.34
5,417,342 A * 5/1995 Hutchison ..... 229/122.32
5,497,899 A * 3/1996 Wuerfel ..... 229/117.13

OTHER PUBLICATIONS

Single-page brochure for shipping box, published circa 2001 by Freight Mate in San Antonio, Texas.

* cited by examiner

*Primary Examiner*—Tri M. Mai
(74) *Attorney, Agent, or Firm*—Dennis W. Gilstad

(57) ABSTRACT

Methods and apparatus are described for reducing damage to items shipped in corrugated boxes, and for reducing damage to the boxes themselves and the packing material within them. Damage is limited by adding one or more planar damped panels to a box for redistributing kinetic energy absorbed by the box when it is subjected to characteristic shipping shock and vibration. Efficient coupling of redistributed kinetic energy to resilient packing material within a box allows the use of relatively less resilient padding surrounding shipped items, thus allowing use of a relatively smaller box to obtain an acceptable level of protection. Planar damped panels also limit shifting of the item(s) to be protected by acting as damped variable-rate springs.

6 Claims, 4 Drawing Sheets

SHOCK RESISTANT BOX

FIELD OF THE INVENTION

The invention relates generally to boxes. More particularly, the invention relates to corrugated boxes having structural features for reducing shipping damage to box contents.

BACKGROUND

Corrugated cardboard boxes offer limited protection from shipping damage, but their low cost and ready availability make them attractive for many one-way shipments. Shocks due to rough handling of truck, rail and aircraft shipments impart kinetic energy to a box that may damage its contents unless the energy is effectively redistributed and dissipated by the box and internal packing materials, rather than being applied to the item(s) to be protected. Dissipation of imparted kinetic energy is typically manifest in localized flexing, crushing or disintegration of portions of box walls and/or packing materials. But the poor energy redistribution that is common in cardboard boxes means that some portions of box walls and packing materials may be overstressed and substantially destroyed while other portions remain undamaged. Unfortunately, failure of the overstressed portions may allow transmission of imparted energy to contents that the box was intended to protect.

Even if the box contents arrive at their destination undamaged, the box and/or its internal packing may be sufficiently degraded to prevent their use for returning defective goods for repair. Attempts to reduce the incidence and severity of damage to both the box and its contents have resulted in design changes applicable to both corrugated boxes and their internal packing materials. See, for example, U.S. Pat. No. 5,417,342, incorporated herein by reference.

When the upper and lower portions of a box according to the '342 patent were assembled, the box assembly had four corrugated layers on each of its four side walls, as well as in the top and bottom closure. But the four layers in the top and bottom closures were interrupted by flaps so that there was no continuous corrugated layer across either the top or bottom of the box assembly. A modification of the '342 box design introduced circa 2001 substituted a single continuous corrugated top wall layer for the top flap closure and, analogously, also substituted a single continuous corrugated bottom wall layer for the bottom flap closure. By eliminating the top and bottom flap closures, a possible failure mode of the '342 box design (i.e., failure caused by the flaps springing open due to shipping shock) was also eliminated. Additionally, the modified box was easier to construct than the original '342 box design.

But field experience showed that the disparity between side wall thickness (i.e., four corrugated layers) and top and bottom wall thickness (i.e., a single corrugated layer) made the modified box especially susceptible to shipping shocks applied to either the top or bottom. This susceptibility was addressed through use of thick internal foam pads across the top and bottom. While effective for reducing shock damage to box contents, these thick foam pads added significantly to the box outer dimensions and thus limited overall packing density achievable with the modified box.

Other corrugated box suppliers addressed the problem of foreshortened service life of corrugated boxes with designs featuring strengthened box walls (e.g., walls having thicker and/or stronger varieties of corrugated material in multiple layers). But such changes alone can actually increase susceptibility to shipping damage to box contents by reducing the box's capacity for energy redistribution and dissipation. If at least a portion of the energy imparted to a box is not redistributed and dissipated by the box itself, it may be transmitted in a damaging localized form to the packing material. And unless the packing material is particularly effective, significant energy may in turn be transmitted to (and may damage) the item(s) intended to be protected. Thus, the use of more robust boxes necessarily increases the need for effective energy redistribution to allow generalized dissipation by the internal packing material without permanent damage. This requirement is especially prominent for boxes comprising relatively strong materials such as corrugated polypropylene.

Consequently, corrugated polypropylene boxes intended for extensive re-use are provided with relatively thick and resilient linings (frequently comprising plastic and/or rubber foam) that conform to the shape of items to be shipped. Such resilient linings can be made relatively light and yet are effective for protecting box contents through dissipation of absorbed kinetic energy. But the thick, soft linings occupy considerable space, while they are less effective for redistributing localized shock energy than more rigid structures. This means that a box suitable for shipping a given item is often relatively large compared to the item to be shipped. Aggregations of such boxes for shipment (as on pallets) are then more likely to be limited by their total volume than by their weight. Transport vehicles and aircraft carrying such shipments operate relatively inefficiently because the overall density of shipments is less than optimal.

If, on the other hand, overall shipment density could be increased to optimal levels at reasonable cost without sacrifice of protection for the goods shipped, the result would be the desirable combination of lower transportation costs and less shipping damage. One approach to achieving this combination lies in raising the efficiency of energy redistribution and dissipation by the system that comprises the corrugated box, the packing materials within, and the item(s) being shipped.

SUMMARY OF THE INVENTION

The present invention relates to methods and apparatus for reducing damage to items shipped in corrugated boxes as described below, and for reducing shipping damage to the boxes themselves while reducing the need for thick internal padding in the box. Damage to box contents is reduced by incorporating at least one relatively thin planar damped panel substantially parallel to and in contact with at least one box wall (i.e., side, top or bottom). The illustrated embodiment shows a box assembly having four corrugated layers in each side wall, a single outer corrugated top layer, a single outer corrugated bottom layer, an internal planar damped panel contacting the top layer and an internal planar damped panel contacting the bottom layer.

As explained below, planar damped panel dissipates at least a portion of kinetic energy absorbed by the box wall it contacts. Additionally, a planar damped panel may redistribute a portion of absorbed kinetic energy because it comprises a semi-rigid energy redistribution member (e.g., a sheet of corrugated, honeycomb, wood, composite or equivalent material). Redistribution of localized energy transmitted through a box wall facilitates its dissipation across a relatively larger volume of packing material (e.g., plastic and/or rubber foam) located elsewhere in the box (i.e., spaced apart from the site of kinetic energy absorption). Location of the semi-rigid planar member (i.e., with respect to its contacting wall and the remainder of box contents), as well as damping, are facilitated by specialized foam layers (or equivalent layers of comparably resilient materials having similar respective compliances in deformation) on either side of the semi-rigid planar member.

Incorporation of one or more of the planar damped panels of the present invention in a corrugated shipping box assembly reduces requirements for resilient packing materials surrounding shipped items by distributing the energy-dissipating function for localized absorbed kinetic (shock) energy over relatively larger areas of internal resilient packing materials. Thus, more efficient use of packing materials within a box for dissipation of absorbed kinetic energy allows use of a relatively smaller amount of these packing materials, and consequently a smaller box, to obtain an acceptable level of protection for the shipped items.

An illustrated embodiment of the present invention shows a shipping box assembly, the box assembly comprising top and bottom portions. The top portion comprises four top-portion side walls and a top-portion top wall, being shaped as a hollow open-ended rectangular parallelepiped. The bottom portion comprises four bottom-portion side walls and a bottom-portion bottom wall, also being shaped as a hollow open-ended rectangular parallelepiped. The top portion telescopes closely and completely over the bottom portion to form a box assembly shaped as a hollow rectangular parallelepiped having four combination side walls, a top-portion top wall and a bottom-portion bottom wall. Each combination side wall of the box assembly comprises a top-portion side wall overlying a corresponding bottom portion side wall.

Each top-portion side wall comprises at least first and second top-portion side-wall corrugated layers secured together (e.g., as by adhesive material, hook-and-eye material such as Velcro, staples and/or fusion). Corrugations in the first and second top-portion side-wall corrugated layers are oriented at right angles. Analogously, each bottom-portion side wall comprises at least first and second bottom-portion side-wall corrugated layers secured together in a manner similar to the top-portion side-wall corrugated layers. Also analogously, corrugations in said first and second bottom-portion side-wall corrugated layers are oriented at right angles.

The top-portion top wall of the box assembly comprises an outer corrugated layer overlying an inner planar damped panel. The planar damped panel, in turn, comprises first, second and third layers, the first layer comprising relatively more compliant open-cell foam and the third layer comprising relatively less compliant closed-cell foam. The second layer comprises a semi-rigid energy redistribution member secured at least peripherally between the first and third layers. These three layers of the planar damped panel assembly are secured to each other (at least peripherally) by, for example, adhesives. The first layer of the planar damped panel is, in turn, adjacent to the top-portion top wall outer corrugated layer. And the top-portion top-wall outer corrugated layer is continuous with each of the top-portion side wall first corrugated layers.

Analogously, bottom-portion top wall of the box assembly comprises an outer corrugated layer overlying an inner planar damped panel. The planar damped panel, in turn, comprises first, second and third layers, the first layer comprising relatively more compliant open-cell foam and the third layer comprising relatively less compliant closed-cell foam. The second layer comprises a semi-rigid energy redistribution member secured at least peripherally between the first and third layers. These three layers of the planar damped panel assembly are secured to each other (at least peripherally) by, for example, adhesives. The first layer of the planar damped panel is, in turn, adjacent to the bottom-portion bottom wall outer corrugated layer. And the bottom-portion bottom-wall outer corrugated layer is continuous with a corrugated layer of each of the bottom-portion side walls.

Note that the combination of a semi-rigid energy redistribution layer secured peripherally between a relatively more compliant open-cell foam (or equivalent) layer and a relatively less compliant closed-cell foam (or equivalent) layer comprises a planar damped panel having different responses to kinetic energy applied to the two sides of the panel. Where the discussion herein refers to open-cell foam or closed-cell foam, the reference is to either the foam type specified or to equivalent material as noted above.

Because a relatively compliant open-cell foam layer separates a semi-rigid energy redistribution member from a box wall (i.e., a top-portion top wall and/or a bottom-portion bottom wall in the illustrated embodiment) of the above box assembly, relatively small displacements (i.e., displacements less than the thickness of the open-cell foam layer) or vibrations of the top or bottom box walls are substantially damped by the adjacent open-cell foam. Thus, relatively low levels of kinetic energy applied during shipping to the top or bottom of shipping box assemblies similar to that illustrated herein are significantly attenuated by the adjacent open-cell foam layer as they are transmitted to the semi-rigid energy redistribution member. Such attenuated energy levels do not require significant redistribution and cause little or no degradation of resilient packing materials in the box. So the item(s) intended to be protected by the box remain undamaged.

On the other hand, relatively higher levels of kinetic energy applied during shipping to the top and bottom walls of shipping box assemblies similar to that illustrated herein may result in relatively large displacements of the box walls that completely compress the open-cell foam layer. Rather than the box wall being loosely coupled to the semi-rigid member, the coupling would then be substantially stronger and capable of causing nearly un-attenuated transmission of the applied energy to the semi-rigid member. The semi-rigid member, in that case, efficiently redistributes the transmitted energy to resilient packing materials within the box via the closed-cell foam layer. While these higher energy levels may be expected to cause some degradation of resilient packing in the box, the degradation would not be localized (thus tending to cause disintegration of the resilient packing material), but would instead be relatively evenly distributed due to the energy redistribution function of the semi-rigid member. The more even degradation thus achieved would reduce the likelihood of localized disintegration of portions of the resilient packing, thereby increasing the likelihood of the safe arrival at their destination of the item(s) intended to be protected by the box.

Note also that the closed-cell foam layer of the planar damped panel is, due to the relatively smaller size of shipping box assemblies of the present invention (compared to boxes without one or more planar damped panels), relatively close to the item(s) intended to be protected. This close spacing tends to limit shifting of the item(s) within the resilient packing with its possible attendant damage to the item(s). Specifically, the synergistic interaction of the closed-cell foam (or equivalent) layer with the semi-rigid energy redistribution member simulates a strongly-damped variable-rate spring. While small shifting displacements of the item(s) to be protected are relatively lightly retarded by the closed-cell foam layer, larger displacements tend to bend the semi-rigid energy redistribution layer and are therefore much more strongly retarded. This variable retardation tends to cushion the item(s) by applying the smallest force necessary to prevent substantial shifting of the item(s).

Minimizing applied forces to limit shifting as above also reduces the likelihood of concomitant damage to the side of the item(s) opposite the side toward which the external kinetic energy is directed. This concomitant damage, should it occur, would be analogous to the contrecoup brain injury that may be seen in patients who have experienced serious head trauma.

In addition to one or more of the above-described planar damped panels, the above shipping box assembly may additionally comprise releasable and reusable closure means attached to the box assembly. These releasable and reusable closure means (e.g., flexible straps secured by buckles and/or hook and eye material) are usable for securing the top and bottom portions of the shipping box assembly together after the top portion is closely and completely telescoped over the bottom portion. Removable plugs (e.g., plastic hand-hold inserts) extending through all layers of a combination side wall may also function as releasable and reusable closure means.

DETAILED DESCRIPTION OF ILLUSTRATED EMBODIMENTS

Figure 1A:
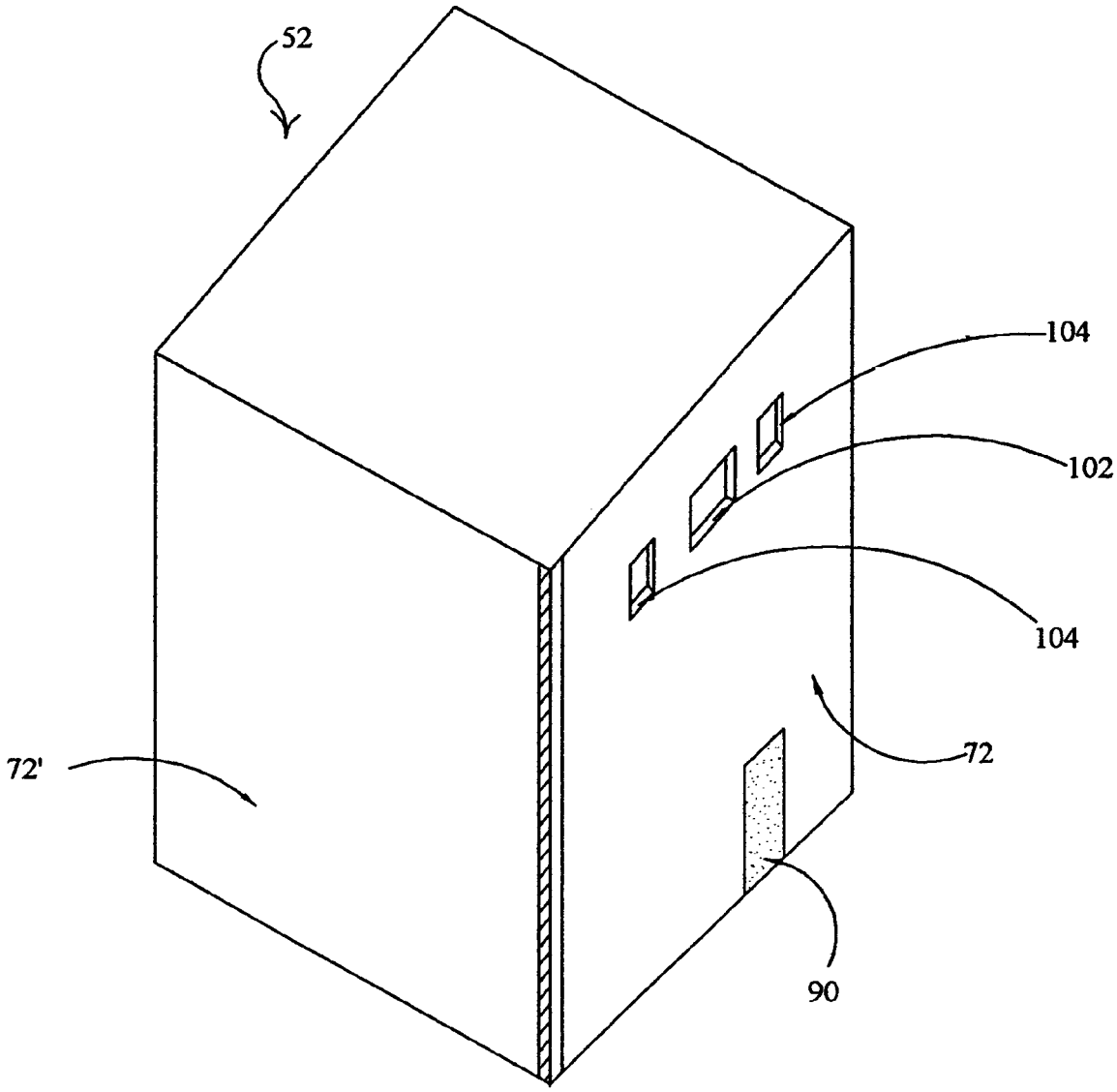
FIG. 1A schematically illustrates a perspective view of the telescoping shipping box assembly of the present invention, showing the upper portion thereof telescoped over the lower portion.
Figure 1B:
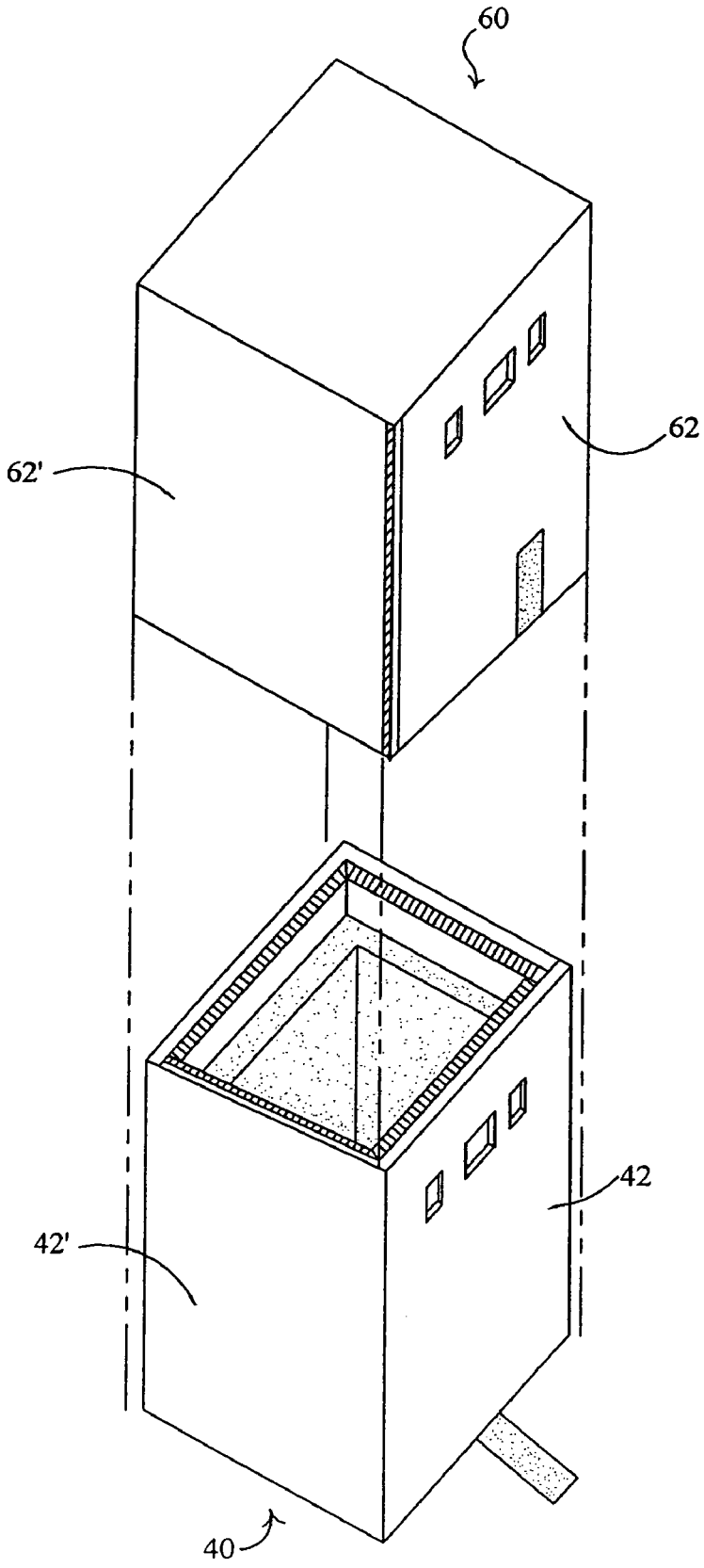
FIG. 1B schematically illustrates an exploded perspective view of the telescoping shipping box assembly shown in FIG. 1A, showing the upper portion thereof removed from the lower portion.

FIG. 1A schematically illustrates a shipping box assembly 52 with the upper portion thereof telescoped over the lower portion and secured by hook and eye releasable and reusable closure means 90. FIG. 1B schematically illustrates an exploded view of the box assembly 52 comprising a top portion 60 and a bottom portion 40. Top portion 60 comprises four top-portion side walls (shown in plan section in FIG. 3A in the form of a first substantially similar opposing pair of top-portion side walls 62,62 plus a second substantially similar opposing pair of top-portion side walls 62',62'), and a top-portion top wall 64 (shown in elevation section in FIG. 2). As shown in FIG. 1A, top portion 60 and bottom portion 40 are each shaped as a hollow open-ended rectangular parallelepiped. Bottom portion 40 comprises four bottom-portion side walls (shown in plan section in FIG. 3B in the form of a first substantially similar opposing pair of bottom-portion side walls 42,42 plus a second substantially similar opposing pair of bottom-portion side walls 42',42'), and a bottom-portion bottom wall 44 (shown in elevation section in FIG. 2).

As shown schematically in FIG. 1A, top portion 60 telescopes closely and completely over bottom portion 40 to form box assembly 52 (see FIG. 1B). Box assembly 52 is shaped as a hollow rectangular parallelepiped (see FIG. 1B) having four combination side walls in the form of a first substantially similar opposing pair of combination side walls 72,72 (shown in elevation section in FIG. 2) plus a second substantially similar opposing pair of combination side walls 72',72' (not shown in FIG. 2 but analogous to side walls 72,72). Box assembly 52 also comprises (as shown in the elevation section of FIG. 2) a top-portion top wall 64 and a bottom-portion bottom wall 44. Each combination side wall 72,72,72',72' comprises a top side wall overlying a corresponding bottom side wall (e.g., top side wall 62 overlying bottom side wall 42 or top side wall 62' overlying bottom side wall 42').

Figure 3A:
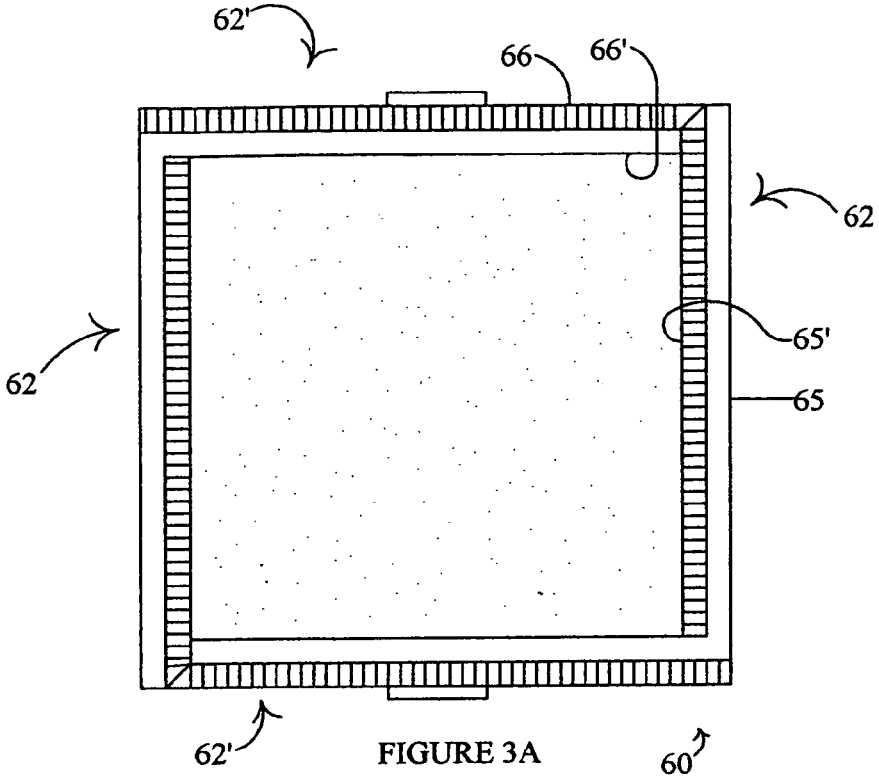
FIG. 3A is a schematic plan view in section through the upper shipping box assembly portion.

As shown in FIG. 3A, each said top-portion side wall 62 comprises at least first and second top-portion side-wall corrugated layers 65,65' respectively secured together (as, for example, with staples and/or adhesive). And each said top-portion side wall 62' comprises at least first and second top-portion side-wall corrugated layers 66,66' respectively secured together. Corrugations in each respective first and second top-portion side-wall corrugated layers that are secured together (e.g., layers 65,65' and layers 66,66') are oriented at right angles.

Figure 3B:
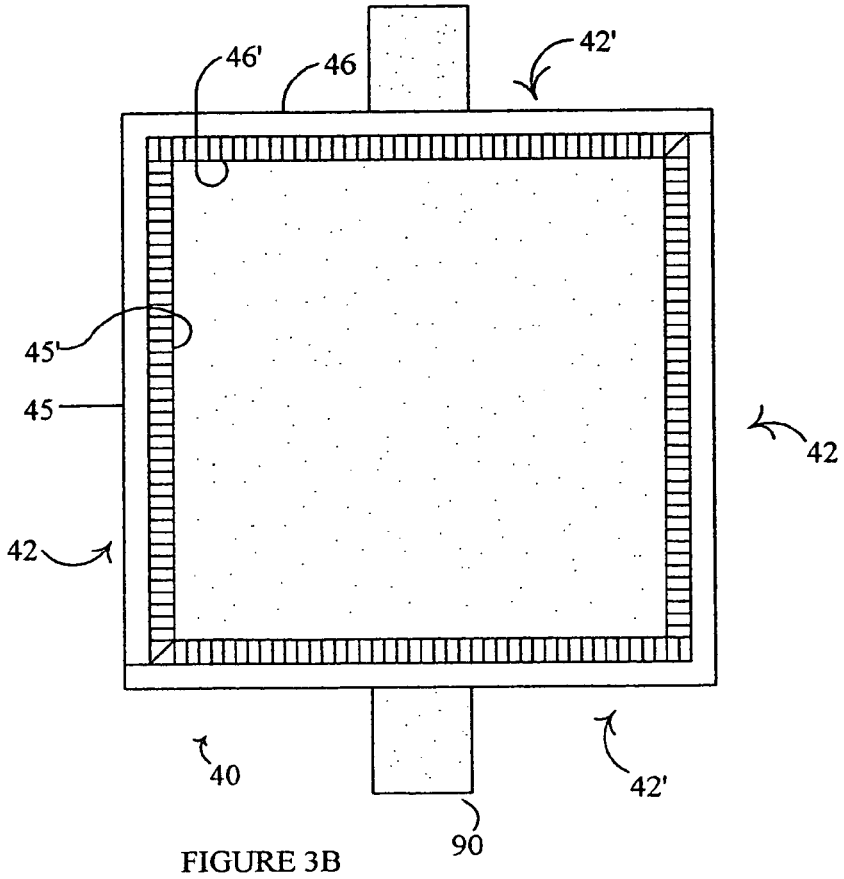
FIG. 3B is a schematic plan view in section through the lower shipping box assembly portion.

Similarly, as shown in FIG. 3B, each said bottom-portion side wall 42 comprises at least first and second bottom-portion side-wall corrugated layers 45,45' respectively secured together (as, for example, with staples and/or adhesives). And each said bottom-portion side wall 42' comprises at least first and second bottom-portion side-wall corrugated layers 46,46' respectively secured together. Corrugations in each respective first and second bottom-portion side-wall corrugated layers that are secured together (e.g., layers 45,45' and layers 46,46') are oriented at right angles.

Figure 2:
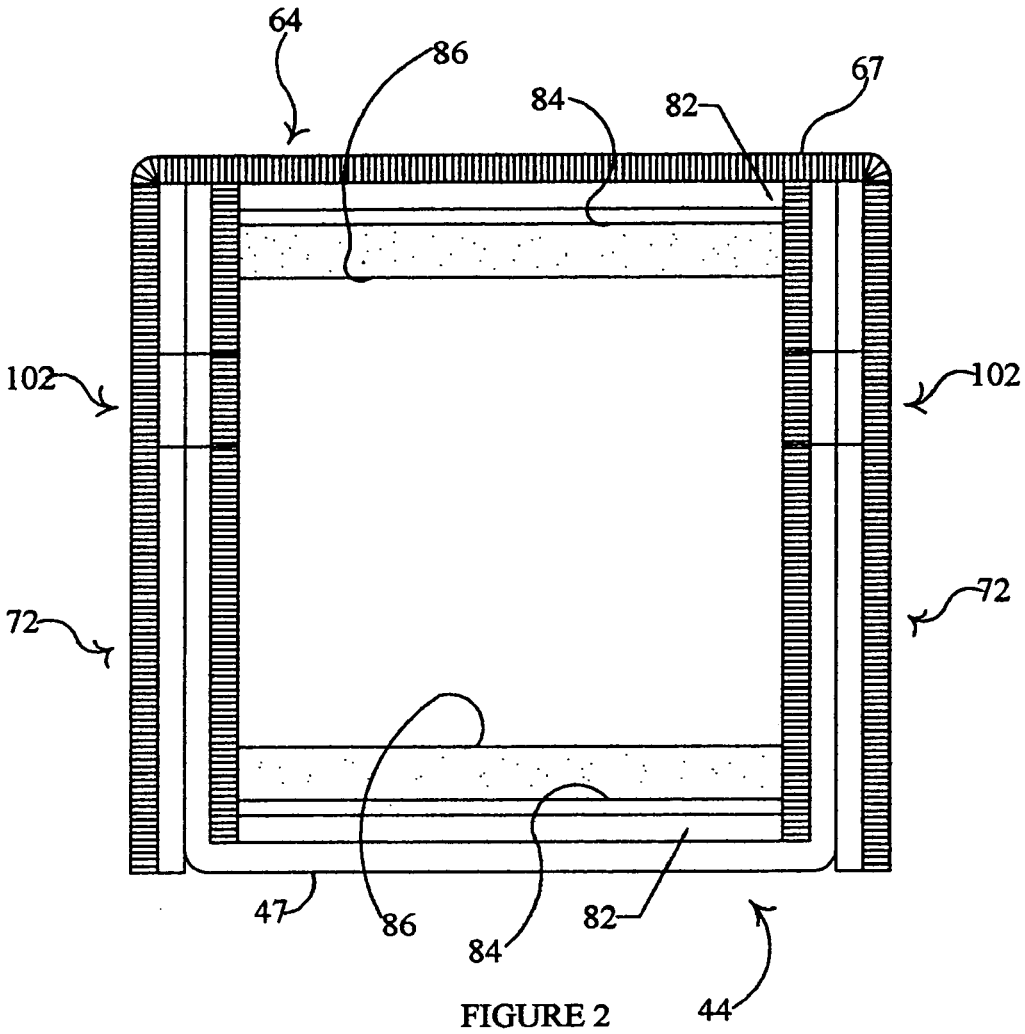
FIG. 2 is a schematic elevation view in section through the assembled top and bottom shipping box assembly portions of FIG. 1.
Figure 4:
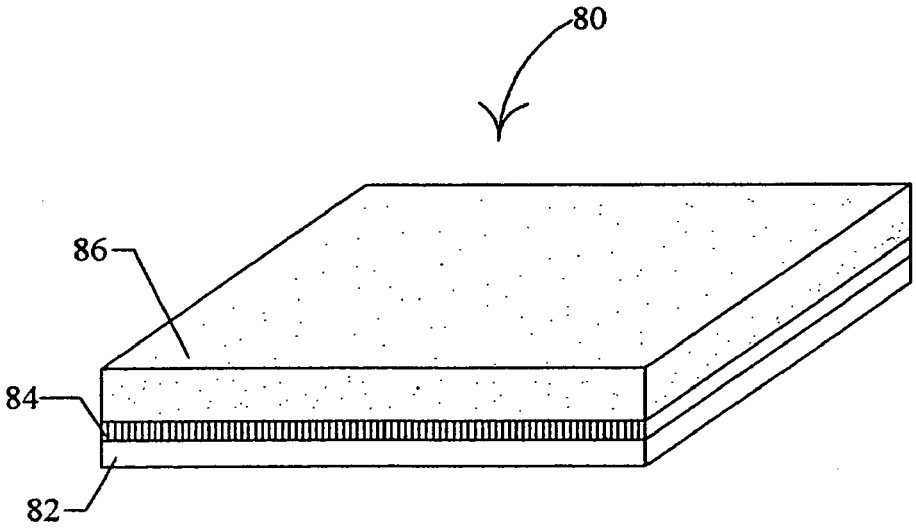
FIG. 4 is a schematic perspective view of a planar damped panel.

Top-portion top wall 64 comprises an outer corrugated layer 67 overlying an inner planar damped panel 80. Planar damped panel 80 (see FIG. 4) comprises first, second and third layers 82, 84 and 86 respectively. First layer 82 comprises open-cell foam and third layer 86 comprises closed-cell foam. Second layer 84 comprises a semi-rigid energy redistribution member (shown in the illustrated embodiment as consisting of a corrugated sheet) secured (as, for example, with staples and/or adhesives) at least peripherally between first layer 82 and third layer 86. As shown in FIG. 2, first layer 82 is adjacent to top-portion top wall outer corrugated layer 67, and top-portion top-wall outer corrugated layer 67 is continuous with each said top-portion side wall first corrugated layer 65 and 66.

Similarly, bottom-portion bottom wall 44 comprises an outer corrugated layer 47 overlying an inner planar damped panel 80. Planar damped panel 80 comprises first, second and third layers 82, 84 and 86 respectively as described above and shown in FIG. 4. And analogous to the structure described above for top-portion top wall 64, first layer 82 of a planar damped panel 80 is adjacent to bottom-portion bottom wall outer corrugated layer 47 (see FIG. 2). Bottom-portion bottom-wall outer corrugated layer 47 is continuous with a corrugated layer of each said bottom-portion side wall (e.g., corrugated layer 45 in each bottom portion side wall 42, and corrugated layer 46' in each bottom portion side wall 42').

Shipping box assembly 52 comprises releasable and reusable closure means 90 (see FIG. 1A) for securing top portion 60 and bottom portion 40 of box assembly 52 together after top portion 60 is closely and completely telescoped over bottom portion 40. In the illustrated embodiment, releasable and reusable closure means 90 is shown comprising hook and eye materials secured (as, for example, with staples and/or adhesives) to top portion 60 and bottom portion 40 respectively.

Shipping box assembly 52 also comprises corresponding hand-holds 102 extending through opposing combination side walls (e.g., opposing combination side walls 72 and 72 or opposing combination side walls 72' and 72'). Analogously, a security port 104 extends through its respective combination side walls adjacent to each handhold.

What is claimed is:

1. A shipping box assembly comprising a top portion comprising four top-portion side walls and a top-portion top wall, said top portion being shaped as a hollow open-ended rectangular parallelepiped;

a bottom portion comprising four bottom-portion side walls and a bottom-portion bottom wall, said bottom portion being shaped as a hollow open-ended rectangular parallelepiped; and releasable and reusable closure means for securing said top and bottom portions of said box assembly together after said top portion is closely and completely telescoped over said bottom portion;

wherein said top portion telescopes closely and completely over said bottom portion to form the box assembly, said box assembly being shaped as a hollow rectangular parallelepiped having four combination side walls, a top-portion top wall and a bottom-portion bottom wall;

wherein each said combination side wall of said box assembly comprises a top-portion side wall overlying a corresponding bottom portion side wall;

wherein at least two opposing combination side walls comprise corresponding hand-holds extending through each said combination side wall;

wherein at least two opposing combination side walls comprise a corresponding security port adjacent to each said hand-hold and extending through each said combination side wall;

wherein each said top-portion side wall comprises at least first and second top-portion side-wall corrugated layers secured together, corrugations in said first and second top-portion side-wall corrugated layers being oriented at right angles;

wherein each said bottom-portion side wall comprises at least first and second bottom-portion side-wall corrugated layers secured together, corrugations in said first and second bottom-portion side-wall corrugated layers being oriented at right angles;

wherein said top-portion top wall comprises an outer corrugated layer overlying an inner planar damped panel, said planar damped panel comprising first, second and third layers, said first layer comprising open-cell foam, said third layer comprising closed-cell foam, and said second layer comprising a semi-rigid energy redistribution member secured at least peripherally between said first layer and said third layer, said first layer being adjacent to said top-portion top wall outer corrugated layer;

wherein said top-portion top-wall outer corrugated layer is continuous with each said top-portion side wall first corrugated layer;

wherein said bottom-portion bottom wall comprises an outer corrugated layer overlying an inner planar damped panel, said planar damped panel comprising first, second and third layers, said first layer comprising open-cell foam, said third layer comprising closed-cell foam, and said second layer comprising a semi-rigid energy redistribution member secured at least peripherally between said first layer and said third layer, said first layer being adjacent to said bottom-portion bottom wall outer corrugated layer; and wherein said bottom-portion bottom-wall outer corrugated layer is continuous with a corrugated layer of each said bottom-portion side wall.

2. The shipping box assembly of claim 1 wherein said releasable and reusable closure means comprise hook-and-eye material.

3. The shipping box assembly of claim 1 wherein each said planar damped panel comprises a semi-rigid energy redistribution member consisting of a honeycomb sheet.

4. The shipping box assembly of claim 1 wherein each said planar damped panel comprises a semi-rigid energy redistribution member consisting of a corrugated sheet.

5. The shipping box assembly of claim 1 wherein each said top-portion side wall comprises at least first and second top-portion side-wall corrugated layers secured together with a plurality of staples.

6. The shipping box assembly of claim 1 wherein each said bottom-portion side wall comprises at least first and second bottom-portion side-wall corrugated layers secured together with a plurality of staples.

* * * * *